United States Patent [19]

Dyer et al.

[11] Patent Number: 4,532,880

[45] Date of Patent: Aug. 6, 1985

[54] BOAT ANCHOR

[75] Inventors: Richard J. Dyer, Broken Arrow; Robert S. Tarpley, Mannford, both of Okla.

[73] Assignee: Diamondback Marine Products, Inc., Tulsa, Okla.

[21] Appl. No.: 600,448

[22] Filed: Apr. 16, 1984

[51] Int. Cl.[3] ..... B63B 21/24

[52] U.S. Cl. ..... 114/298

[58] Field of Search ..... 114/297–299, 114/310

[56] References Cited

U.S. PATENT DOCUMENTS 3,463,112 8/1969 Zakaitis et al. ..... 114/298

3,797,443 3/1974 Woolsey et al. ..... 114/299

*Primary Examiner*—Sherman D. Basinger

*Attorney, Agent, or Firm*—Head, Johnson & Stevenson

[57] ABSTRACT

An anti-fouling anchor for boats, and the like and comprising a shank member having an axially outwardly extending stud member at one end thereof and a transversely extending rod member journalled at the opposite end thereof, a spring urged release rod assembly secured to the transversely extending rod member and releasably engageable with stud member and normally engaged with the stud member for utilization of the anchor in the usual manner for securing the boat in a preselected position in a body of water. Upon accidental lodging of the anchor at the bottom of the body of water, the release rod assembly may be disengaged from the stud member whereby the shank is free to rotation about the longitudinal axis of the transverse rod, thereby permitting the anchor to be "backed away" from the lodged position thereof.

5 Claims, 10 Drawing Figures

BOAT ANCHOR

BACKGROUND OF THE INVENTION

1. Field of the Invention

This invention relates to improvements in boat anchors and more particularly, but not by way of limitation, to a boat anchor for securely retaining a boat in a selected position on a body of water, and releasable for substantially precluding fouling of the anchor and facilitating release thereof from an anchoring position.

2. Description of the Prior Art

It is common practice to secure a boat in a selected position in a body of water by dropping an anchor from the boat for engagement with the bottom or floor of the body of water. When it is desired to release the anchor from engagement with the bottom it is frequently found that the anchor is fouled by underwater debris, tree roots, or the like, and the release of the anchor becomes difficult, if not impossible. The disadvantages of such an operation will be apparent. There have been attempts to overcome this problem by the development of anti-fouling anchors, such as shown in the Illsche U.S. Pat. No. 2,568,006, Brewer Pat. No. 2,764,116; Woolsey et al. U.S. Pat. No. 3,797,443; Miller Pat. No. 4,114,554; and the Fornasiero U.S. Pat. No. 4,230,062. The Woolsey et al. Patent disclosed a boat anchor having a spring urged link means engagable with a mandrel and releasable therefrom upon longitudinal pressure applied against a ring member for pulling the link means axially outwardly. The Brewer patent discloses an anchor retrieving means wherein the haw line is connected to both the upper and lower ends of the anchor, and is releasable from the upper end thereof when the anchor becomes fouled. When the haw line is released from the connection with the upper part of the anchor, the anchor may be backed away or pulled away from its fouled position. The Illsche patent shows an anchor releasing mechanism generally similar to that shown in the Brewer patent. These devices have certain disadvantages, however, in that they appear to be complicated and expensive in construction and somewhat difficult and inefficient in operation.

SUMMARY OF THE INVENTION

The present invention contemplates a novel anti-fouling boat anchor which has been particularly designed and constructed for overcoming the foregoing disadvantages. The novel anchor comprises an elongated shank means having a stud means extending axially outwardly from one end thereof. A transversely extending rod means is journalled through an aperture provided at the opposite end of the shank means whereby the shank means may be rotated about the longitudinal axis of the rod means. A pair of anchor blades are welded or otherwise secured to the opposite ends of the transverse rod means for biting into the lake bottom, or the like, during an anchoring operation. A spring urged release rod assembly has one end thereof pivotally secured to the transverse rod means, and an apertured plate means is provided at the opposite end thereof for releasable engagement with the stud means. The spring means of the release rod assembly constantly urges the plate means into engagement with the outer end of the shank means for providing a normal position of engagement between the plate means and the stud means. An eye means is provided at the outer end of the release rod assembly for attachment to a haw or anchor rope means, as is well known.

In the normally engaged position between the plate means and the stud means, the shank means is held against rotation about the axis of the transverse rod means, and thus provides a stable anchoring position for the anchor blades whereby the novel anchor may be utilized in the normal manner for anchoring a boat in a body of water. When it is desirable to raise the anchor from the bottom of the lake bed, or the like, the haw or anchor rope may be raised or retrieved in the usual manner for lifting the anchor and releasing the anchoring engagement of the anchor blades with the bed or bottom of the lake. In the event the anchor is "fouled" or lodged against a tree root, debris, or the like, present at the bottom of the lake, the anchor rope may be given a sufficient great tug or pull for overcoming the force of the spring, whereupon the plate means will be released from engagement with the stud means, and the shank means will be free to rotation about the longitudinal axis of the transverse rod means. The shank means will then extend from the transverse rod means in a direction away from the engaged ends of the anchor blades, and a continued pull on the anchor rope will be delivered to the blades in a direction opposed to the initial engaged direction thereof. The blades may then be quickly and easily withdrawn from the engaged or fouled position thereof for ready retrieval of the anchor. The novel anti-fouling anchor is simple and efficient in operation and economical and durable in construction.

DESCRIPTION OF THE PREFERRED EMBODIMENT

Figure 1:
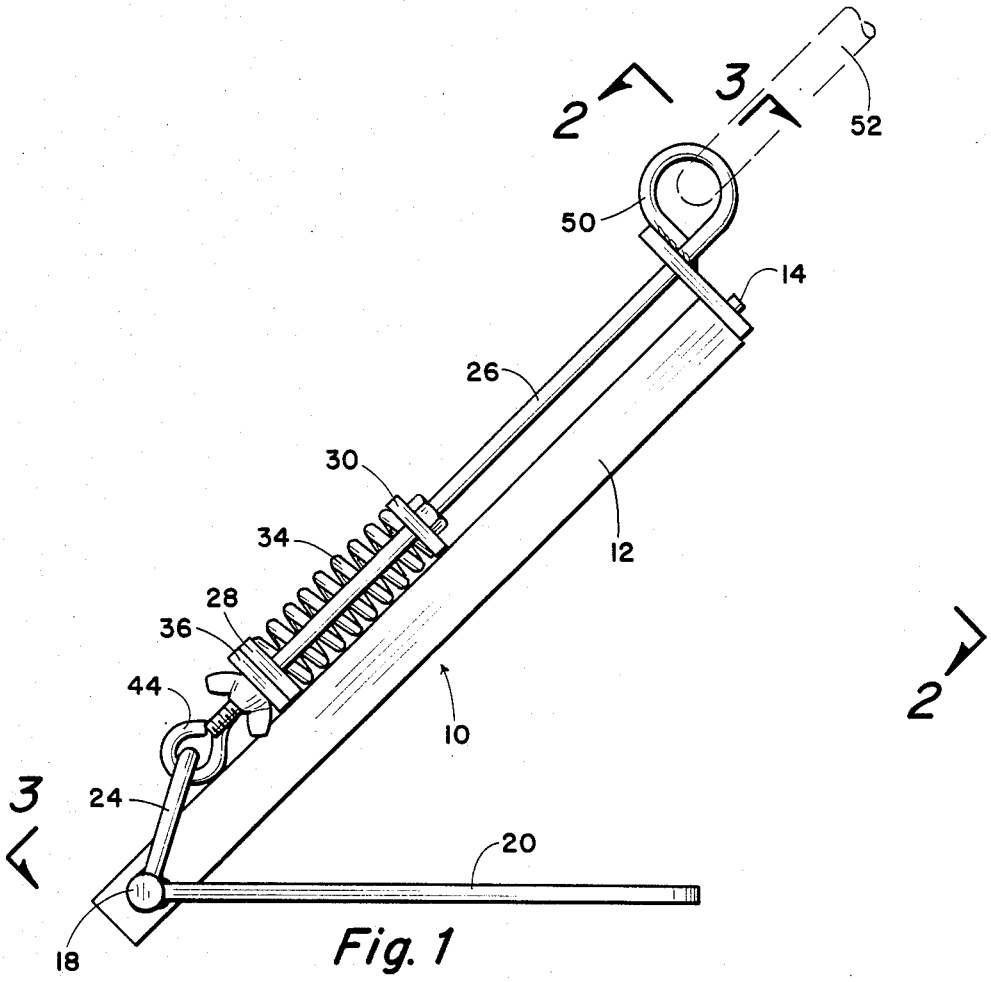
FIG. 1 is a side elevational view of an anti-fouling anchor embodying the invention, and illustrates the normal operating position thereof.
Figure 2:
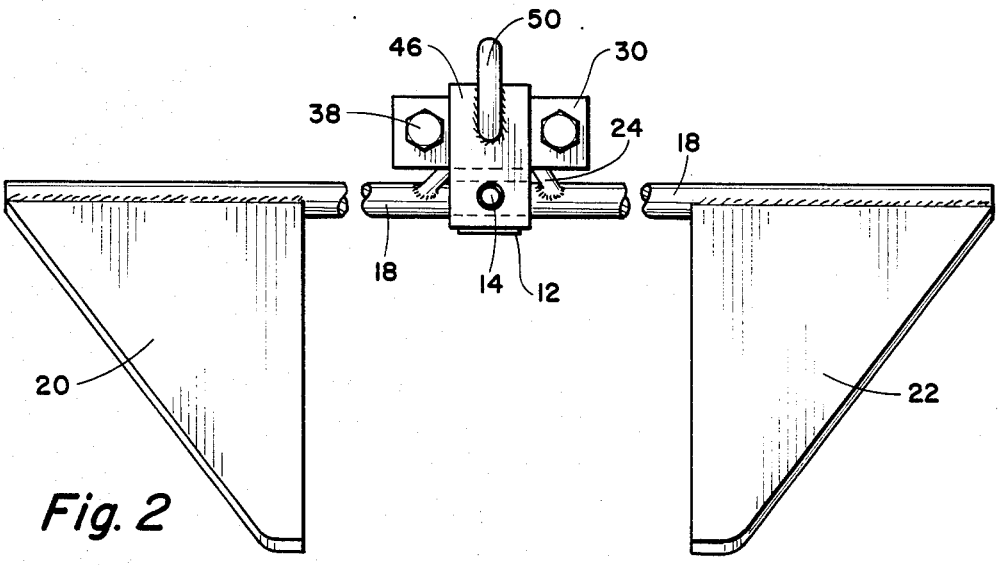
FIG. 2 is a view taken on line 2—2 of FIG. 1.

Referring to the drawings in detail, reference character 10 generally indicates an anti-fouling anchor comprising an elongated shank means 12 having a centrally disposed stud means 14 extending axially outwardly from one end thereof and a transversely extending bore 16 (FIG. 4) provided in the proximity of the opposite end thereof. A transversely extending rod means 18 is journalled in the bore 16 whereby the shank means 12 is free to rotate about the longitudinal axis of the rod means 18 as will be hereinafter set forth. A first anchor blade means 20 may be welded or otherwise rigidly secured to the rod means 18 in the proximity of one end thereof and extends radially outwardly therefrom. A second anchor blade means 22 may be similarly welded or otherwise rigidly secured in the proximity of the opposite end of the rod means 18 and extending radially outwardly therefrom in substantially co-planar relation with respect to the first anchor blade means 20. A substantially centrally disposed bracket member 24 is rigidly secured to the outer periphery of the rod means 18 in any suitable manner, such as by welding, and the opposite ends of the bracket 24 are preferably secured to the rod means 18 on the opposite sides of the shank means 12 for retaining the rod means 18 against accidental withdrawal from the bore 16.

Figures 3, 4, 8:
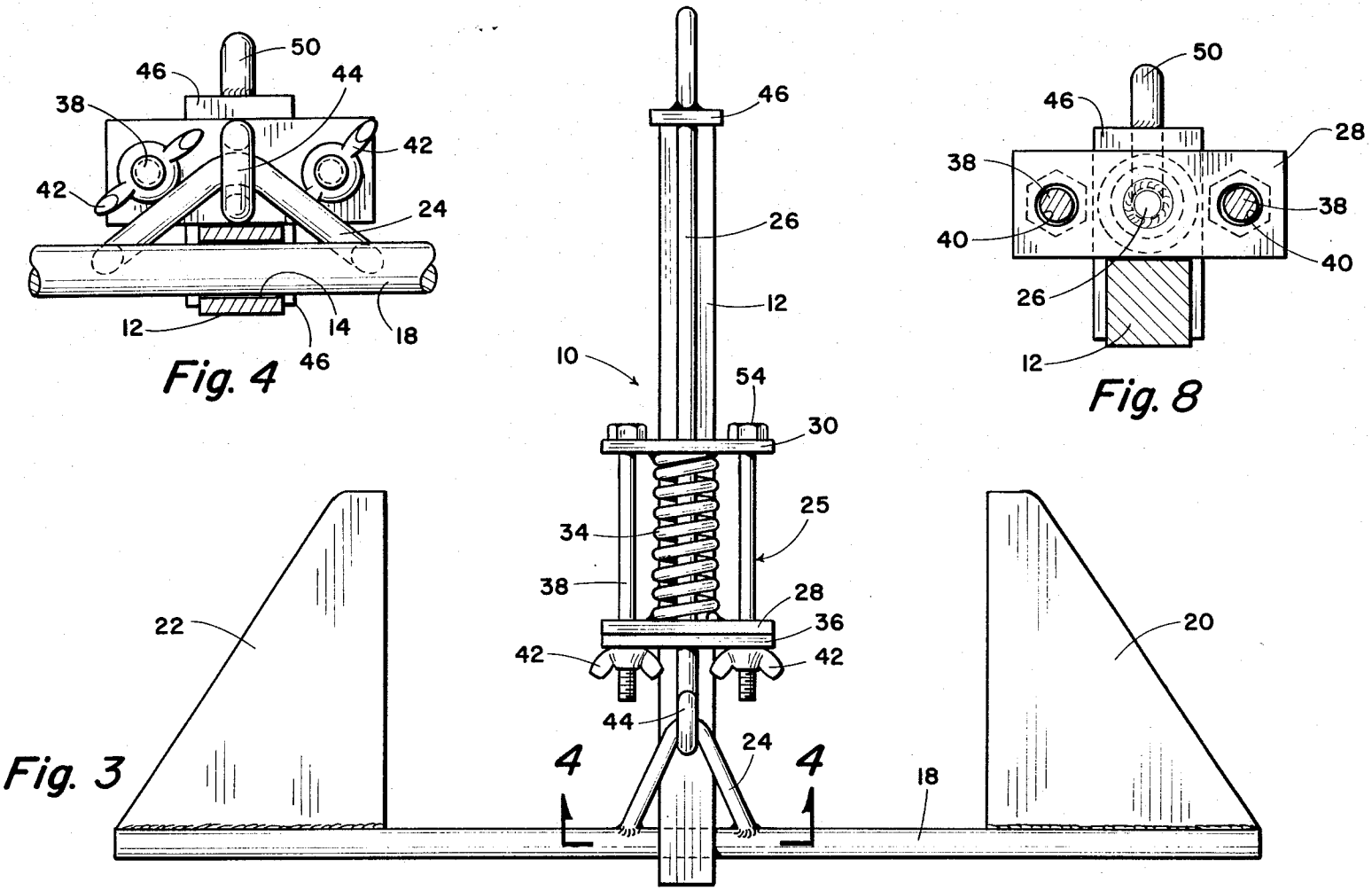
FIG. 3 is a view taken on line 3—3 of FIG. 1.
FIG. 4 is a view taken on line 4—4 of FIG. 3.
FIG. 8 is a view taken on line 8—8 of FIG. 6.
Figure 6:
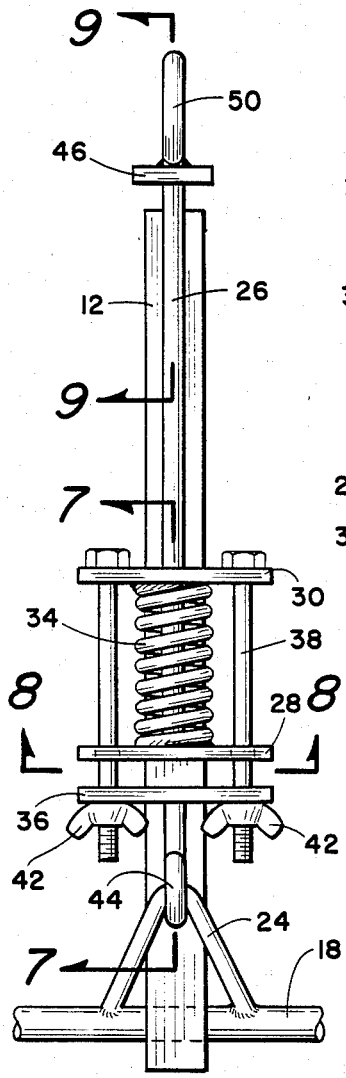
FIG. 6 is a view taken on line 6—6 of FIG. 5.
Figure 7:
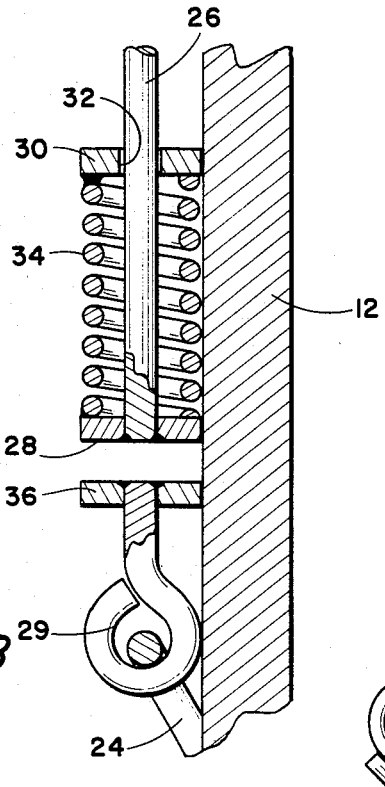
FIG. 7 is a view taken on line 7—7 of FIG. 6.
Figures 9, 10:
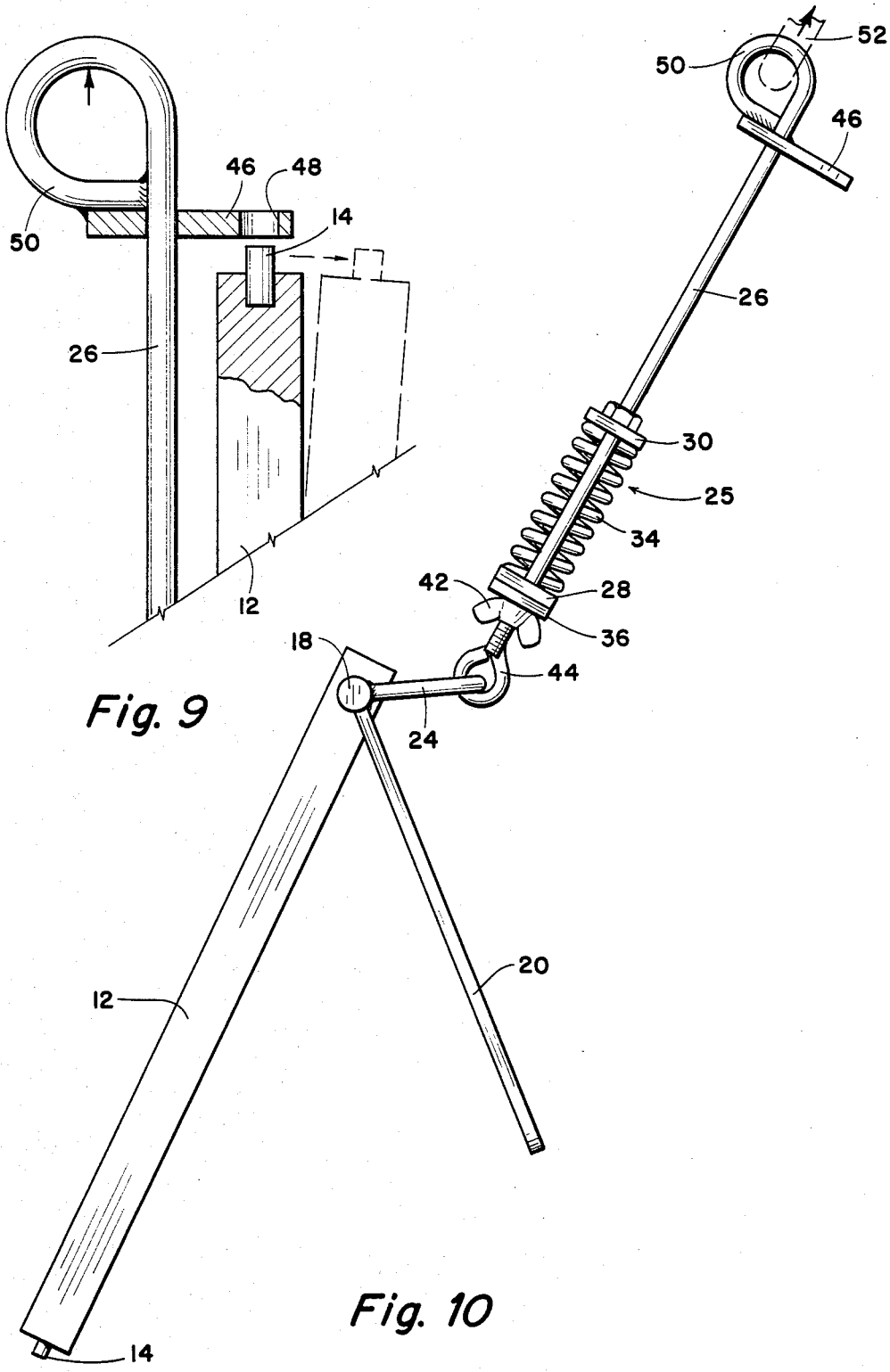
FIG. 9 is a view taken on line 9—9 of FIG. 6.
FIG. 10 is a side elevational view of an anti-fouling anchor embodying the invention, and illustrates a fully released position thereof.

A release rod assembly 25 comprises a rod member 26 having a stop or plate member 28 rigidly secured to one end thereof in any suitable manner, such as by welding. A second stop or plate member 30 is provided with a central bore 32 (FIG. 7) therein for slidably receiving the rod 26 therethrough. A suitable helical spring 34 is disposed around the outer periphery of the rod 26 and suitably anchored between the plates 28 and 30 for supporting the plate 30 in a normally spaced relation with respect to the plate 28. A third stop plate 36 is disposed outboard of the first plate 28, and the plates 28, 30 and 36 are secured together by a plurality of elongated bolt members 38. The bolt members 38 extend slidably through aligned bores 40 (only those of the plate 28 are shown in FIG. 8) and are removably secured in position in any suitable manner, such as by wing nuts 42 bearing against the outer surface of the plate 36. The wing nuts 42 provide for adjusting the force of the spring 34 acting in the plates 28 and 30. This permits setting of the spring force as desired in order to establish the amount of pull necessary of actuation of the device 10 when forced as will be hereinafter set forth. An eye bolt 44, or the like, is secured to the plate 36, and is pivotally secured to the bracket means 24 for pivotally securing the release rod assembly 25 thereto, for a purpose as will be hereinafter set forth. A plate member is welded or otherwise rigidly secured to the outer end of the rod 26 and is provided with an aperture 48 (FIG. 9) for releasable engagement with the stud means 14. In addition, a loop or eye means 50 is provided on the end of the rod 26 disposed outboard of the plate 46 for engagement with or by a suitable anchor rope or haw means 52, as is well known.

In the normal position of the anti-fouling anchor 10, the spring means constantly urges the plate or stop members 28 and 30 in directions away from each other. The movement of the plate 30 in a direction away from the plate 28 is limited by the engagement with the bolt head members 54 of the bolts 38. The movement of the plate 28 in a direction away from the plate 30 is limited by the engagement between the plates 28 and 36. The rod member 26 is thus normally urged in a direction toward the transverse rod means 18 thereby holding the plate member 46 in engagement with the stud member 14 and in engagement with the outer end of the shank means 12. As long as the anchor 10 is maintained in this mode, the anchor may be utilized in the normal manner for anchoring a boat (not shown) or the like in a selected position in a body of water (not shown). In order to release the anchor 10 from the anchoring position, the haw or anchor rope 52 may be retrieved or pulled in the usual manner for removing the anchor blades 20 and 22 from engagement with the bottom of the lake, or the like.

Figure 5:
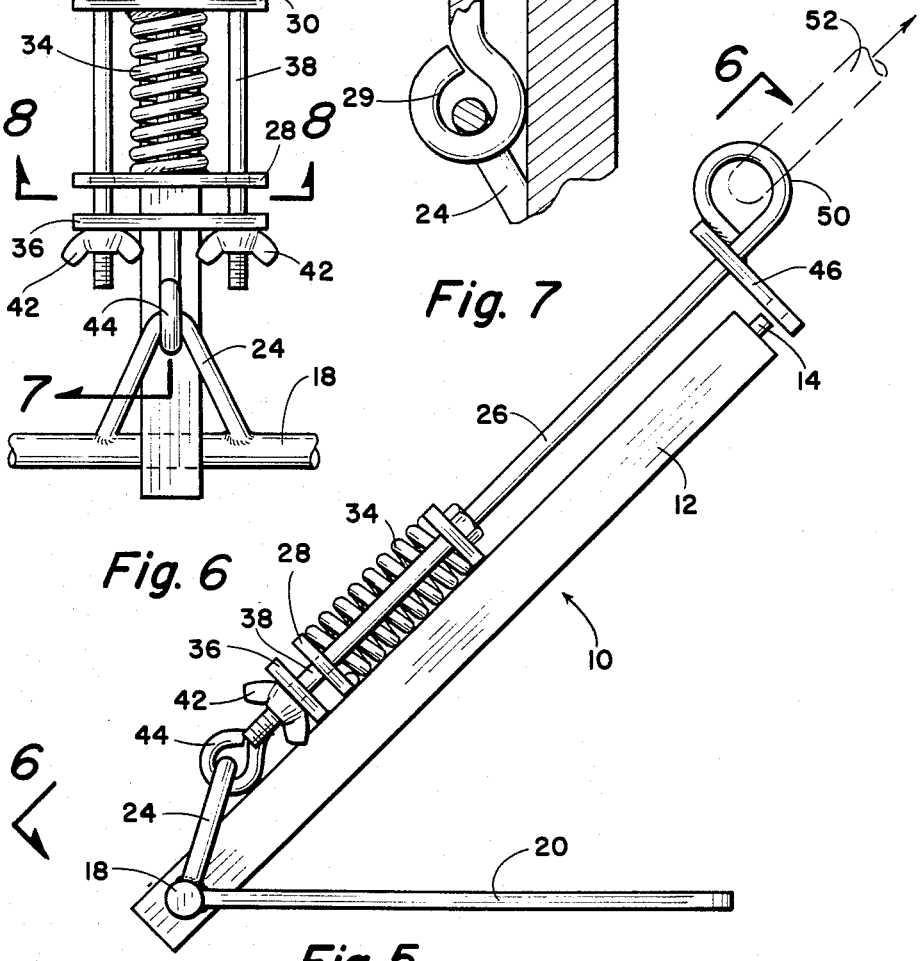
FIG. 5 is a side elevational view of an anti-fouling anchor embodying the invention, and illustrates an initial stage in the release position thereof.

In the event the anchor blades 20 and 22 are "fouled" or lodged at the bottom of the lake in such a manner that the normal pull on the rope 52 will not release the blades from the anchor position, the force on the rope 52 may be increased sufficiently for overcoming the force of the spring means 34. This causes the plate 28 to move in a direction toward the plate 30, contracting the spring 34 therebetween. The rod 26 is thus moved longitudinally in a direction away from the plate 36 whereby the plate 46 is removed from engagement with the outer end of the shank 12 and stud means 14, as particularly shown in FIG. 5. Upon the release of the engagement of the plate 46 with the stud means 14, the shank means 12 is free to rotate about the longitudinal axis of the transverse rod 18 to the position shown in FIG. 10. This moves action of the force of the rope 52 to the rod 18 whereby the pulling force effectively "backs out" the anchor blades 20 and 22 from the lodged position thereof for ready retrieval of the anchor without damage thereto. Of corse, upon retrieval of the anchor at the surface of the water, the device may be "reset" to the normal operating position therefor by moving the plate means 46 into engagement with the stud means 14. Of course, it may be necessary to adjust the position of the wing nuts 42 in order to ease or reduce the force of this spring 34 to facilitate the resetting operation.

It may be desirable to construct the stud means 14 with a threaded outer periphery for cooperation with a complimentary thread longitudinal bore in the shank 12 whereby the length of extension of the stud 14 may be adjusted to exceed the length of travel of the rod 26 in order to selectively preclude a release thereof from the shank. This may be important under extreme conditions wherein anchor holding is more important than retrieval.

From the foregoing, it will be apparent that the present invention provides an anti-fouling anchor for boats, and the like, which may be utilized in the normal manner for anchoring the boat at a preselected position in a body of water. In the event the anchor becomes "fouled" or accidentally lodged at the bottom of the body of water, a force may be exerted on the anchor rope for disengaging the spring urged release rod means from the shank means whereby the pulling force will be moved to the "rear" of the anchor blades for backing the blades from the lodged position thereof without damage to the anchor.

Whereas the present invention has been described in particular relation to the drawings attached hereto, it should be understood that other and further modifications, apart from those shown or suggested herein may be made within the spirit and scope of this invention.

What is claimed is:

1. An anti-fouling anchor for boats and comprising shank means, transversely extending rod means journalled at one end of the shank means, anchor blade means secured to the transverse rod means for selective engagement with the bottom of a body of water for securing the boat in a preselected position therein, spring urged release rod means having a normal position of engagement with the shank means and releasable from the shank means upon a fouling of the anchor blade means whereby the anchor blade means may be released from the fouled position thereof, wherein the release rod means comprises connecting means pivotally secured to the transverse rod means, elongaged rod means having one end yieldably secured to the connection means and the opposite end releasably engagable with the shank means, and means provided at the outer end of the elongated rod means for engagement from the boat for actuation of the rod means for releasing the anchor blade means from the fouled position thereof, and including spring means for yieldably securing the elongated rod means to the connection means.

2. An anti-fouling anchor for boats and comprising shank means, transversely extending rod means journalled at one end of the shank means, anchor blade means secured to the transverse rod means for selective engagement with the bottom of a body of water for securing the boat in a preselected position therein, spring urged release rod means having a normal position of engagement with the shank means and releasable from the shank means upon a fouling of the anchor blade means whereby the anchor blade means may be released from the fouled position thereof, wherein the release rod means comprises connecting means pivotally secured to the transverse rod means, elongated rod means having one end yieldably secured to the connection means and the opposite end releasably engagable with the shank means, and means provided at the outer end of the elongated rod means for engagement from the boat for actuation of the rod means for releasing the anchor blade means from the fouled position thereof, and wherein the connecting means comprises bracket means secured to the transverse rod means, and eye means pivotally secured to the bracket means for securing the elongated rod means thereto.

3. An anti-fouling anchor as set forth in claims 1 or 2 wherein the shank means comprises an elongated shank member having a transversely extending bore provided in the proximity of one end thereof for receiving the transverse rod means therethrough, and a stud member extending axially outwardly from the opposite end of the shank member for releasable engagement by the release rod means.

4. An anti-fouling anchor as set forth in claim 1 wherein the spring means comprises a first stop means rigidly secured at one end of the elongated rod means in the proximity of the connection means, second stop means slidably disposed around the outer periphery of the elongated rod means, and helical spring means disposed around the outer periphery of the elongated rod means and interposed between the first and second stop means for constantly urging the second stop means in a direction away from the first stop means to maintain the release rod means in a normally engaged position with the shank means, and limit means secured between the connection means and first and second stop means for limiting the movement of the first and second stop means in a direction away from each other.

5. An anti-fouling anchor as set forth in claim 2 wherein the bracket means is secured to the transverse rod means on opposite sides of the shank means for retaining the transverse rod means in engagement with the shank means.

* * * * *